United States Patent [19]

Odenthal et al.

[11] Patent Number: 4,665,340

[45] Date of Patent: May 12, 1987

[54] CATHODE-RAY-TUBE ELECTRODE STRUCTURE HAVING A PARTICLE TRAP

[75] Inventors: Conrad J. Odenthal, Portland; Dennis D. Askew, Gresham; Evan W. Jaqua, Portland, all of Oreg.

[73] Assignee: Tektronix, Inc., Beaverton, Oreg.

[21] Appl. No.: 709,480

[22] Filed: Mar. 7, 1985

[51] Int. Cl.[4] ..... H01J 29/48; H01J 29/84

[52] U.S. Cl. ..... 313/449; 313/240

[58] Field of Search ..... 313/424, 445, 456, 481, 313/449, 417, 240

[56] References Cited

U.S. PATENT DOCUMENTS

| | | | |
|---|---|---|---|
| 3,183,388 | 5/1965 | Townsend et al. | 313/451 |
| 3,560,779 | 2/1971 | May | 313/414 |
| 4,298,821 | 11/1981 | Hendry | 313/477 R |

*Primary Examiner*—Palmer C. DeMeo

*Assistant Examiner*—Sandra L. O'Shea

*Attorney, Agent, or Firm*—John P. Dellett; John D. Winkelman

[57] ABSTRACT

A very high resolution cathode-ray tube is provided with a combination cylindrical high voltage electrode and particle trap disk that is supported by a multiplicity of spring fingers from the interior wall of the cathode-ray tube neck. One set of the spring fingers contacts the high voltage coating on the interior of the cathode-ray tube envelope. The particle trap portion is provided with an aperture smaller than the adjacent circumferential edge of the lower voltage electron lens electrode in the adjacent electron gun structure, while the higher voltage electron portion is larger in diameter than the lower voltage electrode of the electron gun structure and overlaps the lower voltage electrode. A ring getter device is supported from the higher voltage electrode.

25 Claims, 4 Drawing Figures

CATHODE-RAY-TUBE ELECTRODE STRUCTURE HAVING A PARTICLE TRAP

BACKGROUND OF THE INVENTION

The present invention relates to cathode-ray tube electrode structure and particularly to electrode structure for providing improved operation in very high resolution cathode-ray tubes.

The resolution in cathode-ray tubes is of considerable concern where finely detailed information is to be presented, e.g., on the screen of a computer terminal portraying a great deal of graphic and alphanumeric data. High resolution tubes tend to be operated at high voltages, for example, above 18 KV. Moreover, the tube's electron lens should be of the largest diameter possible to decrease aberrations and may therefore employ the interior tube coating as the high voltage electrode of a bipotential electron lens. In a tube with this open structure, particle contamination of electron gun electrodes is a problem. For example, loose particles released from an aluminized screen, as the tube is shocked or vibrated, may become deposited on the low voltage element of the bipotential electron lens and cause spurious electron emission.

In many cathode-ray tubes, the high voltage element of the electron lens forms a part of the electron gun structure, i.e., it is secured to insulating rods extending in supporting relation to the gun structure. While this configuration is less subject to contamination, nevertheless high voltage breakdown can occur since the electron gun glass support rods provide insufficient insulation. Moreover, supporting the high voltage element from the electron gun structure tends to reduce the diameter of the lens because the insulating rods are normally positioned at the exterior circumference of such element.

Another problem in very high resolution tubes relates to the placement of the getter used for absorbing gases. Getter mounting in a tube employing an inside coating for a high voltage lens electrode has been limited to the anode button or shadow mask. This positioning makes it difficult to reclaim the tube bulb owing to the difficulty of replacing the getter in the bulb with limited neck access. Also, if the tube faceplate is attached to the bulb by a frit baking process, the getter has its overall effectiveness reduced by the high temperature processing. The getter would be more desirably mounted on a high voltage gun electrode, but as heretofore mentioned this type of electrode has serious disadvantages.

SUMMARY OF THE INVENTION

According to the present invention, a cathode-ray tube is provided with a particle trap disposed across the neck of the cathode-ray tube, this particle trap being supported independently of the electron gun structure by contacting means bearing against the interior surface of the tube neck. In particular the contacting means comprises a multiplicity of spring fingers which bear against the interior neck surface and make contact with the high voltage coating on the interior surface of the bulb. The particle trap is desirably disk shaped including a central aperture which is smaller in diameter than the diameter of the low voltage lens electrode mounted on the electron gun structure. Therefore, the lower voltage electrode and particularly, the forward edge thereof are substantially shielded from the deposition of particles from the forward end of the tube.

According to a preferred embodiment of the present invention, a higher voltage electrode of the bipotential electron lens comprises a cylinder which is unitary with or supported from the aforementioned particle trap and extends from the particle trap toward the lower voltage bipotential lens electrode of the electron gun structure. This cylinder is of larger diameter than the outside diameter of the lower voltage lens electrode while being closely spaced to the inside wall of the cathode-ray tube neck. The cylindrical higher voltage electrode effectively extends the interior wall coating of the cathode-ray tube in the direction of the lower voltage electrode to provide a large diameter lens. However, high voltage breakdown problems associated with rod-mounted high voltage electrodes are avoided. In accordance with a specific embodiment, the higher voltage electrode cylinder is disposed in overlapping relation to the forward end of the lower voltage electrode to shield against neck glass charging.

A getter is desirably attached to the particle trap-high voltage electrode structure, and may comprise a ring getter mounted coaxially with the particle trap in a plane perpendicular to the axis of the tube, or may comprise an "antenna" getter mounted forwardly in the tube by a metal strap. Therefore the getter structure is easily retrieved if desired.

It is accordingly an object of the present invention to provide an improved high resolution cathode-ray tube having means for preventing contamination of the electron gun and therefore preventing undesired emission.

It is another object of the present invention to provide an improved high resolution cathode-ray tube having an improved high voltage electrode which is less subject to arcing problems than prior structures, while providing a large diameter, low aberration lensing action.

It is a further object of the present invention to provide an improved high resolution cathode-ray tube with a high voltage electrode which is less subject to punch-through problems than cathode-ray tubes employing an interior wall coating alone.

It is a further object of the present invention to provide an improved high resolution cathode-ray tube with a getter mounted on the neck electrode structure in the tube.

The subject matter of the present invention is particularly pointed out and distinctly claimed in the concluding portion of this specification. However, both the organization and method of operation, together with further advantages and objects of the present invention, may best be understood by reference to the following description taken in connection with accompanying drawings wherein like reference characters refer to like elements.

DRAWINGS

FIG. 1 is a longitudinal cross sectional view of a cathode-ray tube according to the present invention, FIG. 2 is an end view of electrode structure according to the present invention, FIG. 2 being taken from view line II—II in FIG. 1, FIG. 3 is a plan view of getter structure employed with the FIG. 1 cathode-ray-tube, and FIG. 4 is an enlarged, longitudinal, cross sectional view of a cathode-ray tube in accordance with a second embodiment of the present invention.

DETAILED DESCRIPTION

Figure 1:
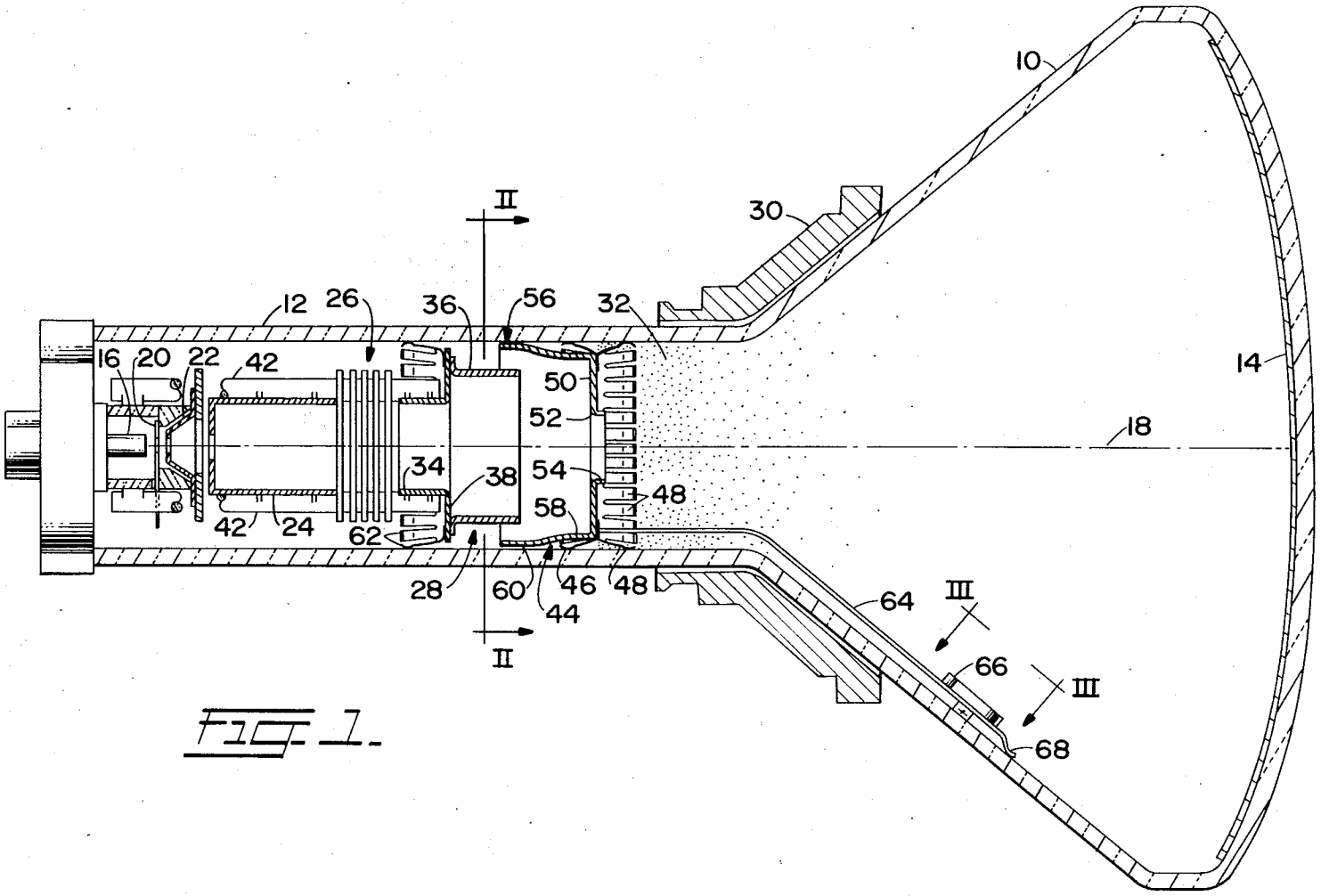

Referring to the drawings and particularly to FIG. 1, illustrating an improved cathode-ray tube according to the present invention, such cathode-ray tube includes a forward funnel portion 10 and a rearward, cylindrical neck portion 12, the latter housing an electron gun apparatus emitting an electron beam 18 for "writing" on the forward phosphor screen 14. The electron gun structure comprises a cathode 16 producing the electron beam successively passing through apertures in grid 20 and second grid 22, and through an aperture in one end of anode cylinder 24. At the remote end of anode cylinder 24 the electron beam 18 traverses a group of wafer electrodes generally indicated at 26, further described and claimed in copending application Ser. No. 708,602 filed Mar. 5, 1985. After exiting electrodes 26, the electron beam 18 passes through focus electrode 28 comprising a smaller diameter cylindrical portion 34 positioned adjacent the electrode group 26, and a larger cylindrical portion 36 oriented toward the face of the tube and joined to portion 34 by radial flange 38. The inside of the tube toward screen 14 from electrode 28 is provided with a coating 32 which in the region of the neck of the tube is suitably of high resistance. The coating is connected to the high accelerating voltage of the cathode-ray tube. In a prior type of tube, e.g. as disclosed in the aforementioned copending application Ser. No. 06/708,602, the coating 32 served alone as the higher voltage electrode of a bipotential electron lens used in focusing beam 18 while electrode 28 served as the lower voltage electrode of such electron lens.

The electron beam is deflected by magnetic deflection yoke 30. This magnetic deflection yoke may be of substantially any type commonly used for deflecting an electron beam in a cathode-ray tube in two orthogonal directions, but is preferably stator-wound on a slotted ferrite core. Litz wire coils and a suitable magnetic material are preferably used to reduce skin effect and core losses at high deflection frequencies.

Figure 2:
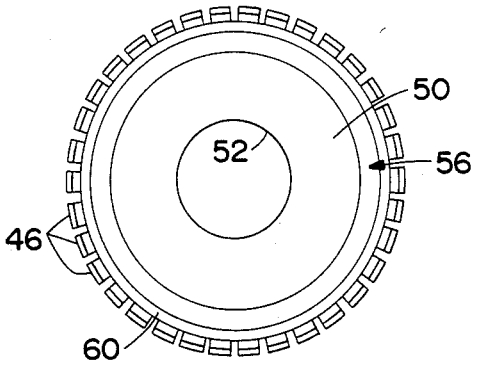

Electrodes 16, 20, 22, 24, 26 and 28 are included in a common electron gun structure wherein the electrodes are supported by glass insulating rods 42 extending from the small end of the tube. As hereinbefore mentioned, the insulating characteristics of the support rods sometimes become a limiting factor for the voltages at which the tube can be operated. However, electrode structure 44 according to the present invention is independently supported within the neck 12 of the cathode-ray tube by means of a pair of "snubbers" 46 and 48 each comprising a multiplicity of flat metal spring biased outwardly bearing fingers extending in opposite directions in cantilever fashion along the tube neck from particle trap disk 50. The snubber fingers, which are substantially contiguously arrayed around the circumference of particle trap 50, are illustrated in greater detail in FIGS. 2 and 4. The fingers 48 make electrical contact with high voltage coating 32 which suitably extends no farther toward the small end of the tube than particle trap 50.

Particle trap 50 comprises a metal disk extending substantially across the neck of the tube and is provided with a central aperture 52 defined by cylindrical axial flange 54 extending toward the screen end of the tube. Together with support fingers 46 and 48, the particle trap extends all the way across the neck of the tube for blocking particles dislodged from the screen end of the tube from depositing on lower voltage electrode 28 where they could produce spurious emissions. Spurious emission is especially likely if such deposit were to occur on the forward, screen end of larger diameter portion 36 of electrode 28. The central aperture 52, toqether with axial flange 54, is large enough in diameter to pass electron beam 18 and allow for adequate pumping efficiency of the tube, while shielding the forward edge of electrode 28 from particle deposition along the axial direction of the tube. For this reason, aperture 52 is substantially smaller in inside diameter than the inside diameter of electrode portion 36. In a particular example, where the inside diameter of the tube neck was 1.26 in. (3.2 cm) inches and electrode portion 36 had a diameter of 1.0 in. (2.5 cm) aperture 52 had a diameter of 0.5 in. (1.3 cm). The diameter of aperture 52 is suitably in the range of 0.125 to 0.5 in. (0.3 to 1.3 cm) for the aforementioned tube diameter. The 0.5 in. (1.3 cm) diameter hole provides a six times reduction in area of the cross section of the tube neck. Together with axial flange 54 and fingers 48, the particle trap disk 50 provides a cup-like configuration which collects particles and prevents them from reaching lower voltage electrode 28.

Further in accordance with the present invention, electrode structure 44 includes a high voltage metal electrode 56 which is cylindrical in shape and which extends axially toward electrode 28 from particle trap 50. Electrode 56 is unitary with or joined to particle trap 50 at its periphery and is commonly supported by fingers 46 and 48 in closely spaced adjacent relation to the inside wall of tube neck 12. In particular, the cylindrical electrode 56 suitably comprises a first cylindrical portion 58 having the same diameter as the exterior diameter of particle trap 50 where the latter is supported by the aforementioned fingers, and the cylindrical electrode flares to a larger diameter portion 60 near the contacting end portions of fingers 46. Thus, the inside diameter of cylindrical portion 60 is nearly as great as the inside diameter of the tube neck and can function to provide a large diameter lensing action in the same manner as coating 32, while such coating is located farther toward the screen end of the tube. The cylindrical metal electrode extends the coating 32 toward electrode 28 without requiring that spring fingers 48 contact any more than the edge of coating 32 when the electrode structure 44 is inserted in the neck of the tube, thereby avoiding the dislodging of particulate material by scraping of the spring fingers along the tube coating. The cylindrical metal electrode 56 functions to provide the desired large diameter lensing action without the high voltage breakdown danger attendant to prior art high voltage electrodes mounted on the electron gun structure.

The higher voltage electrode 56 according to the present invention and the lower voltage electrode 28 together provide a bipotential electron lens used in focusing the electron beam 18 on phosphor screen 14. The voltage applied to electrode 28 is typically 2.5 kilovolts while the voltage applied to higher voltage electrode 56 as well as to coating 32 is suitably in the range of 18 to 25 kv whereby a well focused, bright spot is produced on the screen 14, but with the attendant possibility of high voltage breakdown. However, the electrode 56 is supported independently of the electron gun structure, i.e., it is not supported by rods 42 but is supported by fingers 46 and 48 from the neck of the tube whereby the higher voltages may be utilized without the danger of arcing.

The cylindrical electrode 56 is also substantially larger in diameter than lower potential electrode 28 and suitably extends in surrounding relation to the forward end of portion 36 of electrode 28. This overlapping configuration shields the glass neck of the cathode-ray tube in the inter-electrode region preventing charging of the cathode-ray tube in a manner that would deleteriously affect the focus of the electron beam. The metal high voltage electrode 56 additionally avoids "punch through" of the glass tube neck that may occur in "spot knocking" when only a coating 32 is employed. During the "spot knocking" process, a higher than normal voltage is applied between electrode 28 and the high voltage electrode means to burn undesired points from the lower voltage electrode 28. When employing only a coating 32 for the higher voltage electrode, it was possible to burn a hole in the neck of the tube.

There is thus provided a combination particle trap and higher voltage electrode for the cathode-ray tube bipotential electron lens which avoids the problems of utilizing the interior tube coating alone as a higher voltage electrode with attendant possibility of particle deposition, and which avoids a higher voltage electrode on the gun structure that might shield against some particle deposition but which would be subject to insulation breakdown at high voltages. Although the electrode structure 44 is thus not rodded onto the gun, it is adequately centered with respect to the desired center position of the electron beam by means of the surrounding support fingers 46 and 48 making contact with the neck of the tube, the tube neck desirably being precision-made to insure correct centering. Moreover, the lower voltage electrode 28 and the forward end of the gun structure is registered with the position of structure 44 by means of a second snubber or set of support fingers 62 cantilevered toward the small end of the tube from extended flange 38 of electrode 28. These spring fingers are substantially identical in construction to fingers 46 and 48. They also inhibit breakdown due to high voltage "creep" along the tube neck by a secondary emission mechanism, and inhibit passage along the neck of the tube toward the small end, of any particulate material that may have reached that point.

Figure 3:
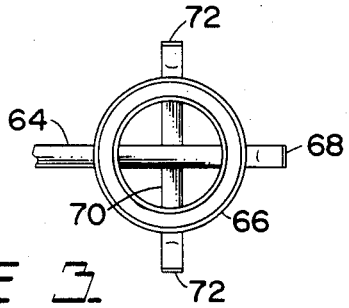

In the FIG. 1 embodiment, an "antenna" getter is mounted on the particle trap 50, utilizing a metal strap 64 secured to the particle trap and extending in generally parallel relation to the side wall of the tube into funnel portion 10 beyond deflection yoke 30. The getter structure, which is illustrated in greater detail in FIG. 3, includes an inwardly directed circular metal trough 66 containing getter material, e. g. barium. The strap 64 suitably includes an outwardly directed tab 68 making contact with tube coating 32, and a cross strap 70 secured to strap 64 and provided with end tabs 72 also contacting the tube wall coating. This getter structure is thus located at the high voltage end of the tube but may be retrieved with the electron gun for reclaiming purposes.

Figure 4:
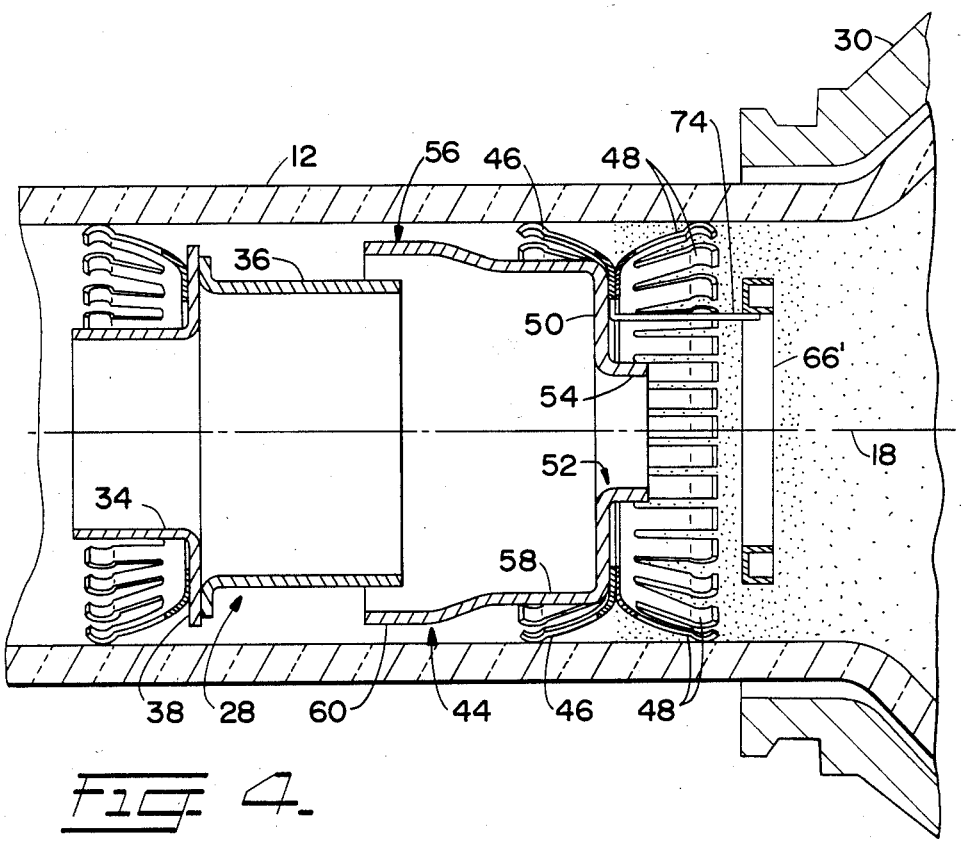

Referring now to FIG. 4, electrode structure according to the present invention drawn to an enlarged scale further includes a getter structure according to an alternative embodiment. This getter structure comprises a circular metal trough 66' containing getter material and directed axially downstream of the electron beam in coaxial relation to structure 44. The getter is supported by a rod 74 secured to particle trap 50 for disposing the getter structure in a plane perpendicular to the axis of the tube. In the case of either getter structure 66 or getter structure 66', the getter is "flashed" in a conventional manner employing a primary induction coil which induces high frequency currents in the circular getter structure operating as a coil secondary. As in the case of the previous embodiment, the embodiment of FIG. 4 provides desired getter positioning and retrieval should it be desired to reclaim the cathode-ray tube envelope.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. In a cathode-ray tube having an electron gun structure provided with at least a lower voltage electrode of an electron lens used in focusing the electron beam of said cathode-ray tube, a higher voltage electron lens electrode in the neck of said cathde-ray tube interposed between said lower voltage electrode and the screen end of said cathode-ray tube, said higher voltage electrode being cylindrical in shape and disposed in adjacent relation to the interior of the neck of said tube, said higher voltage electrode being larger in diameter than said lower voltage electrode, and contacting means disposed around the outside diameter of said higher voltage electrode for bearing against the interior of the neck of said cathode-ray tube to provide support for said higher voltage electrode which is independent of said electron gun structure.

2. The apparatus according to claim 1 further including a disk shaped particle trap extending across the interior of said higher voltage electrode and provided with a central aperture for passing said electron beam.

3. The apparatus according to claim 1 wherein said higher voltage electrode extends in partially surrounding relation to said lower voltage electrode.

4. The apparatus according to claim 1 wherein said lower voltage electrode is provided with second contacting means for bearing against the interior of the neck of said cathode-ray tube for centering said lower voltage electrode with respect to said higher voltage electrode.

5. The apparatus according to claim 1 wherein said contacting means comprises a multiplicity of biased, flat metal fingers mounted around the circumference of said higher voltage electrode for bearing on the inside surface of the neck of said cathode-ray tube.

6. The apparatus according to claim 1 wherein said contacting means make electrical connection with the high voltage coating on the interior of said cathode-ray tube.

7. The apparatus according to claim 1 further including getter means mounted on said higher voltage electrode.

8. In a cathode-ray tube, an electron gun provided with at least a lower voltage electrode of an electron lens used in focusing the electron beam of said cathode-ray tube, said lower voltage electrode having a cylindrical portion oriented toward the screen end of said cathode-ray tube, a higher voltage electrode of said electron lens supported in the neck of said cathode-ray tube between said lower voltage electrode and the screen end of said cathode-ray tube, said higher voltage electrode being cylindrical in shape and larger in diameter than said cylindrical portion of said lower voltage electrode, and a particle trap disposed across said higher voltage electrode for shielding said lower voltage electrode from loose particles from the screen end of said cathode-ray tube, said particle trap having a central aperture for passing said electron beam, said central aperture being smaller in diameter than said cylindrical portion of said lower voltage electrode.

9. The apparatus according to claim 8 wherein said higher voltage electrode extends in partially surrounding relation to said lower voltage electrode.

10. The apparatus according to claim 8 wherein said higher voltage electrode is supported in adjacent relation with respect to the interior of the neck of said cathode-ray tube by a multiplicity of biased fingers extending from said higher voltage electrode and bearing against the interior of the neck of said cathode-ray tube.

11. The apparatus according to claim 10 wherein said biased fingers extend toward the screen end of said cathode-ray tube and make contact with the conductive coating on the interior of said cathode-ray tube.

12. The apparatus according to claim 10 wherein said lower voltage electrode is partially supported by a multiplicity of biased fingers extending from said lower voltage electrode and bearing against the interior of the neck of said cathode-ray tube.

13. The apparatus according to claim 8 wherein said higher voltage electrode is supported in adjacent relation with respect to the interior of the neck of said cathode-ray tube by first and second sets of spring biased fingers extending from the periphery of said higher voltage electrode and bearing against the interior of the neck of said cathode-ray tube, a first set of said fingers extending generally longitudinally of said cathode-ray tube in cantilever fashion in a direction toward the screen end of said cathode-ray tube, and a second set of said fingers extending generally longitudinally of said cathode-ray tube in cantilever fashion in a direction toward the gun end of said cathode-ray tube.

14. The apparatus according to claim 8 including getter means mounted on said higher voltage electrode.

15. In a cathode-ray tube having an elongate neck portion containing an electron gun structure that includes means for producing an electron beam directed toward a spaced-apart screen within the tube, said gun structure including a first electron lens element adjacent an end of the structure facing said screen, means defining a particle trap within said neck portion intermediate said first lens element and said screen, said particle trap including a disk-shaped member extending substantially across said neck portion to form a particle barrier between said first lens element and screen, said member including a central aperture accommodating passage of said electron beam, and means for resiliently supporting said particle trap within said neck portion independent of said gun structure.

16. The cathode-ray tube of claim 15, wherein said first lens element includes a cylindrical portion extending toward said screen, and wherein the diameter of said central aperture in the disk-shaped particle trap member is smaller than the diameter of said cylindrical portion.

17. The cathode-ray tube of claim 15, further including a second electron lens element separate from said electron gun structure and operated at a higher electrical potential than said first lens element, and wherein said particle trap is electrically conductive and is operated at said higher potential.

18. The cathode-ray tube of claim 17, wherein said second lens element comprises a cylindrical member extending from said particle trap toward said first lens element, said second lens element being larger in diameter than the adjacent portion of said first lens element.

19. The cathode-ray tube of claim 18, wherein said second lens element extends in partially surrounding relation to said first lens element.

20. The cathode-ray tube of claim 18, wherein said first lens element is provided with means for centering said first lens element and said electron gun structure in said neck portion and thereby align them with respect to said second lens element.

21. The cathode-ray tube of claim 15, wherein said particle trap includes a cylindrical portion surrounding said central aperture and extending from said disk-shaped member toward said screen.

22. The cathode-ray tube of claim 15, wherein said supporting means comprises a plurality of resilient metal fingers surrounding the circumference of said trap and bearing on the inner surface of said neck portion.

23. The cathode-ray tube of claim 15, further including a getter assembly mounted on said particle trap.

24. The cathode-ray tube of claim 23, wherein said getter assembly comprises a ring-shaped trough containing getter material, said trough being disposed in perpendicular relation to the central axis of said tube with the open side of the trough facing said screen.

25. The cathode-ray tube of claim 23, wherein said getter assembly comprises an elongated support member attached at one end to said particle trap and extending toward said screen, and a receptacle portion containing getter material secured to the opposite end of said support member.

* * * * *